US006682205B2

(12) United States Patent
Lin

(10) Patent No.: US 6,682,205 B2
(45) Date of Patent: Jan. 27, 2004

(54) FLEXIBLE ROD LIGHT AND MANUFACTURING METHOD THEREOF

(76) Inventor: Yuan Lin, 5 Viewmont Court, Doncaster East, 3109 VIC. (AU)

( * ) Notice: Subject to any disclaimer, the term of this patent is extended or adjusted under 35 U.S.C. 154(b) by 0 days.

(21) Appl. No.: 10/304,738

(22) Filed: Nov. 27, 2002

(65) Prior Publication Data

US 2003/0193801 A1 Oct. 16, 2003

(30) Foreign Application Priority Data

Apr. 16, 2002 (TW) ..... 91107787 A

(51) Int. Cl.[7] ..... F21S 4/00

(52) U.S. Cl. ..... 362/249; 362/800; 362/222; 362/223

(58) Field of Search ..... 362/800, 249, 362/217, 222, 223

(56) References Cited

U.S. PATENT DOCUMENTS

| | | | | | |
|---|---|---|---|---|---|
| 6,158,882 | A | * | 12/2000 | Bischoff, Jr. | 362/488 |
| 6,283,612 | B1 | * | 9/2001 | Hunter | 362/240 |
| 6,354,714 | B1 | * | 3/2002 | Rhodes | 362/153.1 |
| 6,394,623 | B1 | * | 5/2002 | Tsui | 362/249 |
| 6,478,449 | B2 | * | 11/2002 | Lee et al. | 362/249 |
| 6,565,251 | B2 | * | 5/2003 | Chen | 362/806 |

* cited by examiner

*Primary Examiner*—Laura K. Tso
(74) *Attorney, Agent, or Firm*—Troxell Law Office PLLC

(57) ABSTRACT

Flexible rod light device and manufacturing method thereof are disclosed. The device comprises an inner layer including a plurality of equally spaced apart dents on a top groove; a string of LED lamps comprising a plurality of series connected units each including a LED lamp, two bent conductor sections with the LED lamp therein received, and a resistor; a pair of main wires parallel disposed in the inner layer proximate sides; and a jacket wrapped up the inner layer and the string of LED lamps. All LED lamps are secured and have the same orientation for achieving an increased illumination.

9 Claims, 6 Drawing Sheets

FLEXIBLE ROD LIGHT AND MANUFACTURING METHOD THEREOF

BACKGROUND OF THE INVENTION

1. Field of the Invention

The present invention relates to LED (Light Emitting Diode) means and more particularly to a flexible rod light device containing a string of LED lamps and manufacturing method thereof.

2. Description of Related Art

A process of manufacturing a conventional flexible rod light is shown in FIG. 7. First, solder a terminal 2*a* of a LED lamp 2 to one end of a conductor section 3. Next, pull the conductor section 3 to pass a side of the LED lamp 2. Then, solder a terminal 2*b* of a second LED lamp 2 to the other end of the conductor section 3. Then, repeat above three processes to form a string of LED lamps. Next, put a continuous sleeve 1 around the string of LED lamps. Then, wrapping the sleeve 1 with a plastic material (not shown) by extrusion to form a jacket. As a result, the flexible rod light is formed.

However, the prior art suffered from several disadvantages. For example, there is no support means between any two adjacent LED lamps 2 with the conductor section 3 bent therebetween. Further, the LED lamps 2 and the conductor sections 3 tend to be stuck within the sleeve 1 during the manufacturing process. This is particularly true when the sleeve 1 has a length longer than a predetermined one, resulting in an interrupt of the manufacturing process. In a less serious case, a distance between two adjacent LED lamps 2 may be different from that of another two adjacent LED lamps 2. And in turn, the already bent conductor section 3 is further bent or extended. As an end, a desired configuration of equal spaced apart LED lamps 2 is not obtainable. Consequently, a uniform light emitted from the light device is made impossible. Furthermore, an excessive pulling of one LED lamp 2 from an adjacent LED lamp 2 may break the conductor section 3, thus disconnecting the electrical connection of the light device. Also, LED lamps 2 tend to displace slightly in the sleeve 1, i.e., not reliably secured. As such, light emitted from a displaced LED lamp 2 may not concentrate in a direction parallel to, for example, X-Z plane, i.e., being oblique relative to the X-Z plane.

Thus, it is desirable to provide an improved flexible rod light and manufacturing method thereof in order to overcome the above drawbacks of the prior art.

SUMMARY OF THE INVENTION

It is an object of the present invention to provide a flexible rod light device wherein light emitted from LED lamps can concentrate in a direction perpendicular to the top surface thereof to thereby increase illumination.

It is another object of the present invention to provide a flexible rod light device wherein a string of LED lamps enhances flexibility of the conductor section when used.

It is further object of the present invention to provide a flexible rod light device wherein the components of LED lamps and resistors are protected from damage.

It is still further object of the present invention to provide a flexible rod light device wherein the LED lamps are readily fastened and installed when assembling, and each of lamps has a same orientation.

It is still further object of the present invention to provide a flexible rod light device wherein a string of LED lamps and resistors is easily installed due to flat top and bottom surface of jacket.

In one aspect of the present invention to provide a flexible rod light device, comprising a substantially H-shaped inner layer formed of a flexible elongate transparent or half-transparent plastic material and comprising lengthwise top and bottom grooves and a plurality of equally spaced apart dents on the top groove; a string of LED lamps comprising a plurality of series connected units each including a LED lamp, two substantially 90 degrees bent conductor sections with the LED lamp received in a substantially U section of the conductor sections and electrically connected thereto by connecting terminals of the LED lamp to one ends of adjacent conductor sections, and a resistor interconnecting the other end of the conductor section and the other end of the conductor section of an adjacent unit wherein straight portions of the conductor sections and the LED lamp of each unit are rested on the dent and two wing portions of the conductor sections are rested on the top groove; a pair of main wires parallel disposed in the inner layer proximate sides wherein front most and rearmost conductor sections are rested on the main wires in front and rear sides of the inner layer respectively; and a jacket, formed of the same material as the inner layer, wrapped up the inner layer and the string of LED lamps. By utilizing this, a number of advantages are obtained. For example, the LED lamps are fastened and have the same orientation. Enhanced flexibility of the conductor sections on, for example, X-Y plane to withstand a pulling of the light. Protection resistors against damage. Easy installation is effected due to the flat top and bottom surfaces of the jacket.

It is another aspect of the present invention to provide a method of manufacturing a flexible rod light device comprising the steps of (a) wrapping a parallel pair of main wires in a substantially H-shaped inner layer formed of a flexible elongate plastic material proximate sides by molding; (b) soldering one end of a resistor to the other end of one conductor section and the other end hereof to the other end of another adjacent conductor section and soldering terminals of a LED lamp to one ends of the adjacent conductor sections for a unit including the LED lamp, two conductor sections, and the resistor; (c) continuing step (b) to form a string of LED lamps including a plurality of units; (d) bending the conductor sections of each unit and inserting straight portions of the conductor sections and the LED lamp of each unit into one of a plurality of dents on a top of the inner layer with two wing portions of the conductor sections rested on a top groove of the inner layer; (e) disposing front most and rearmost conductor sections on the main wire in front and rear sides of the inner layer respectively; and (f) wrapping up the inner layer and the string of LED lamps by the same material as the inner layer by extruding to form a jacket.

The above and other objects, features and advantages of the present invention will become apparent from the following detailed description taken with the accompanying drawings.

DETAILED DESCRIPTION OF THE PREFERRED EMBODIMENTS

Figure 1:
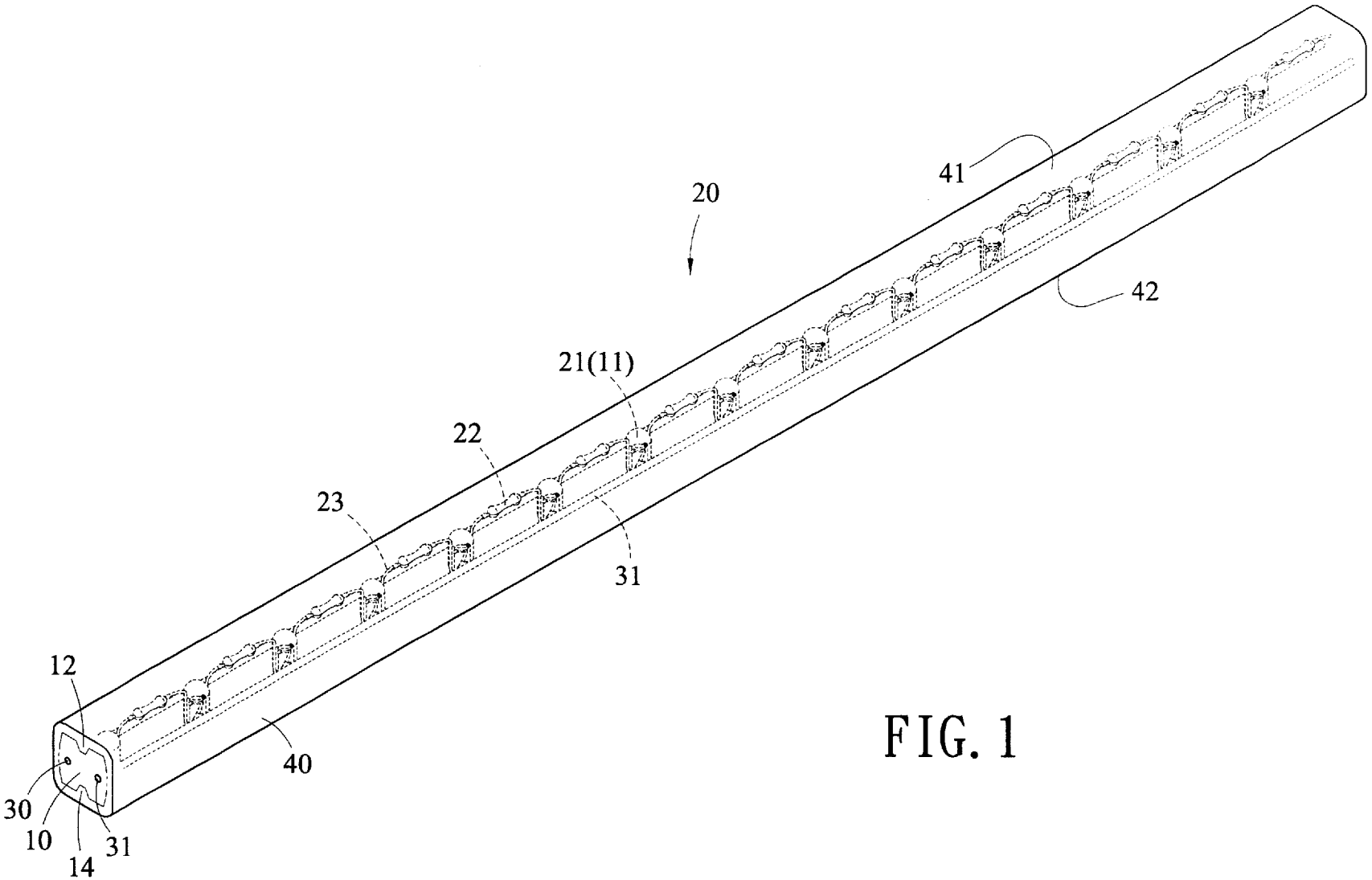
FIG. 1 is a perspective view of a preferred embodiment of flexible rod light according to the invention.
Figure 2:
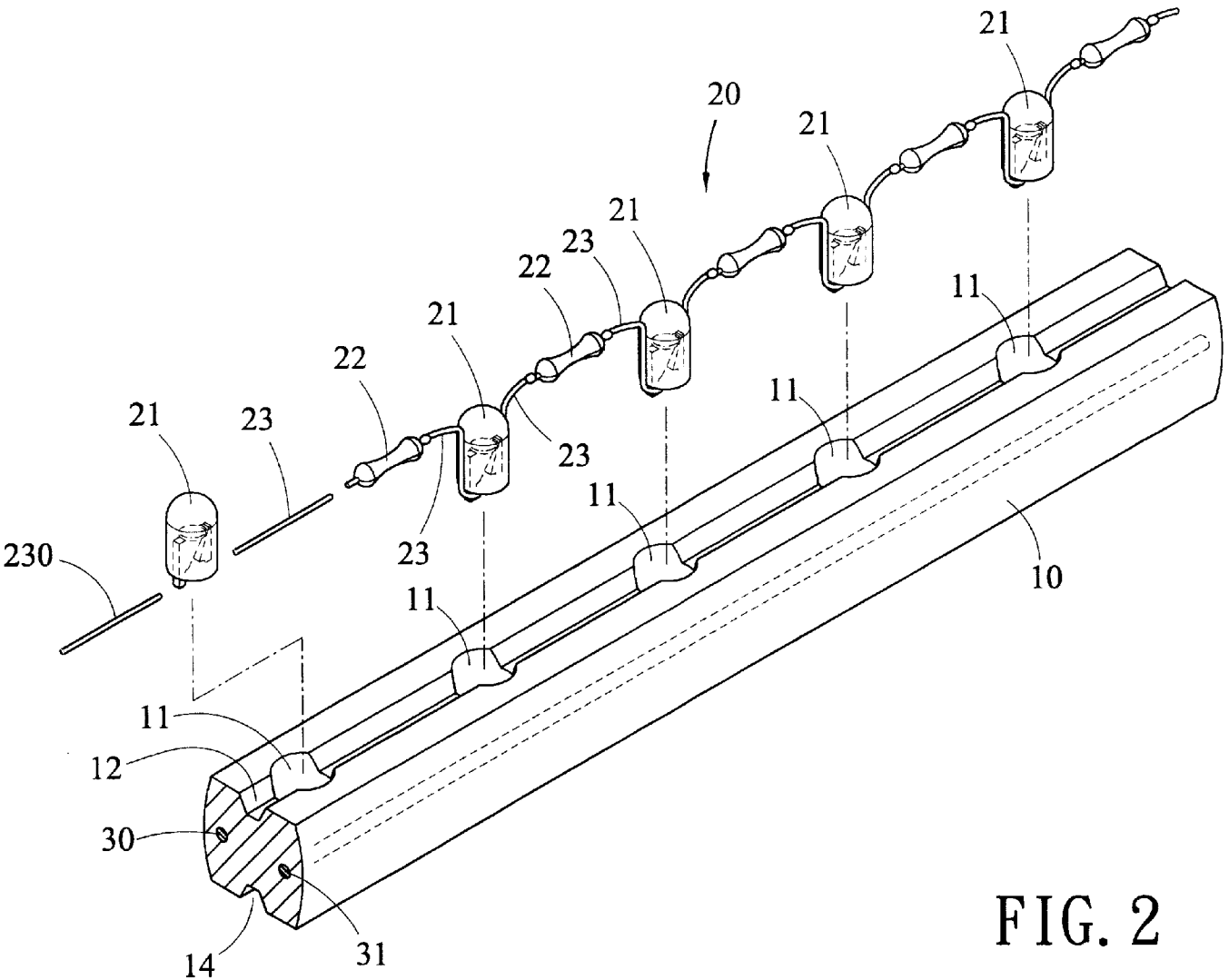
FIG. 2 is an exploded perspective view of the string of LED lamps and the inner layer with the jacket removed for clarity.
Figure 3:
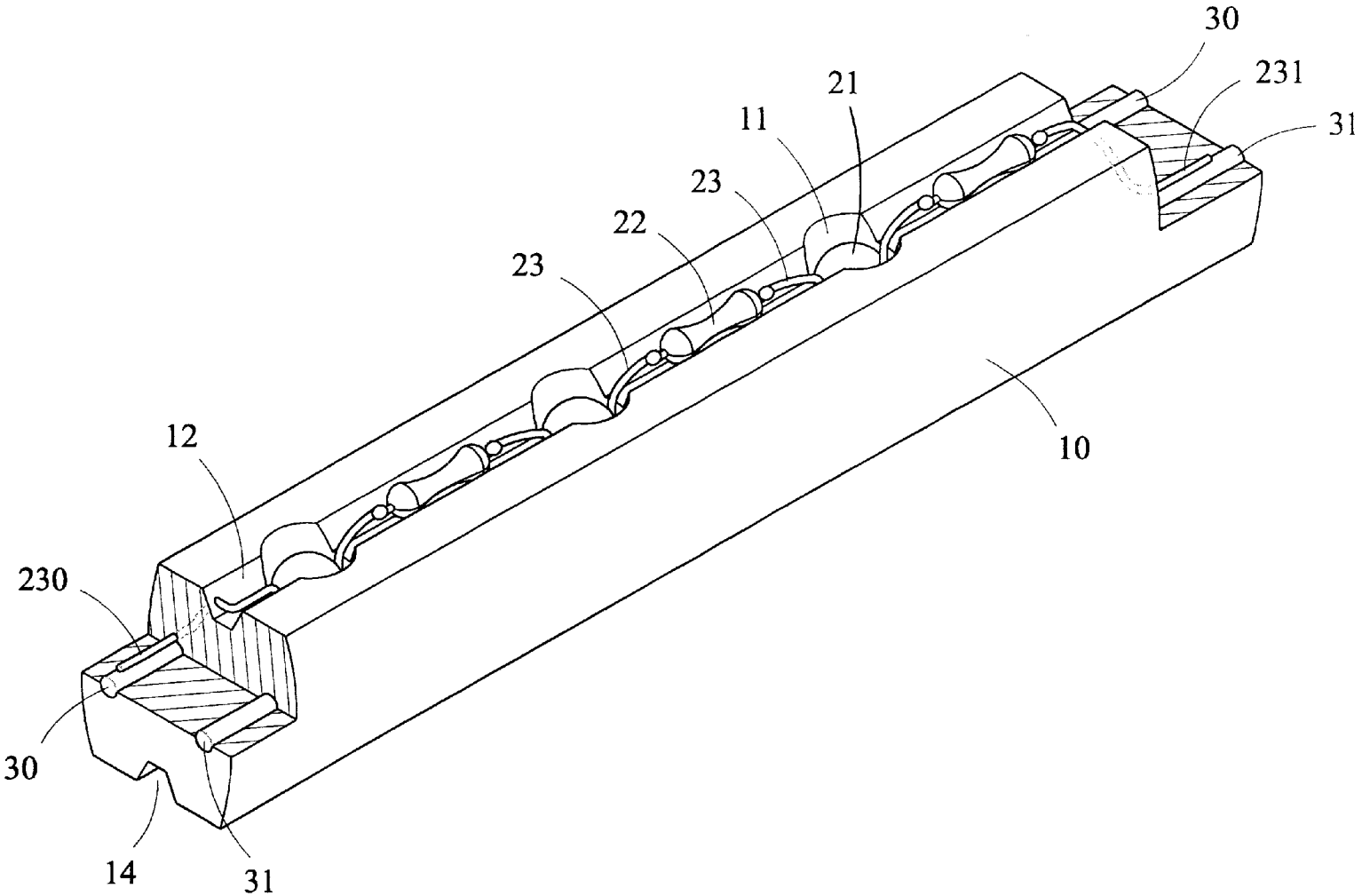
FIG. 3 is a perspective view in part section of the assembled string of LED lamps and the inner layer according to the invention.

Referring to FIGS. 1, 2 and 3, there is shown a flexible rod light device in accordance with the invention. The light device comprises an inner layer 10, a string of LED lamps 20, a pair of main wires 30 and 31, and a jacket 40. Each of above components will now be described in detail below.

The inner layer 10 is a flexible elongate transparent (or half-transparent) plastic material and comprises lengthwise grooves 12 and 14 on top and bottom respectively and a plurality of equally spaced apart dents 11 on the groove 12. Thus, a substantially H-shaped cross-section of the inner layer 10 is formed. The string of LED lamps 20 comprises a plurality of units each including a LED lamp 21, two substantially 90 degrees bent conductor sections 23 with the LED lamp 21 received in a U section of the conductor sections 23 and electrically connected thereto by connecting the terminals of the LED lamp 21 to one ends of the adjacent conductor sections 23 by soldering, and a resistor 22 interconnecting the other end of the conductor section 23 and the other end of the conductor section 23 of an adjacent unit by soldering. Thus, LED lamps 21 are series connected one by one. Further, straight portions of the conductor sections 23 and the LED lamp 21 of each unit are rested on the dent 11 and two wing portions of the conductor sections 23 are rested on the top groove 12. The pair of main wires 30 and 31 are parallel disposed in the inner layer 10 proximate the sides. A front most conductor section 230 is rested on the main wire 30 in a front side of the inner layer 10 by a tool. Likewise, a rearmost conductor section 231 is rested on the main wire 31 in a rear side of the inner layer 10 by a tool. As such, the main wires 30 and 31 interconnect a power source (not shown) and the string of LED lamps 20 to form an electric circuit. The jacket 40, having the same plastic material as the inner layer 10, is formed to wrap up the inner layer 10 and the string of LED lamps 20 by extrusion. The jacket 40 has flat top and bottom surfaces 41 and 42.

A process of manufacturing the flexible rod light device of the invention comprises the steps of:

Step 1: Wrap the parallel pair of main wires 30 and 31 in the inner layer 10 proximate the sides by molding.

Step 2: Solder one end of the resistor 22 to the other end of one conductor section 23 and the other end thereof to the other end of another adjacent conductor section 23. Solder the terminals of the LED lamp 21 to one ends of the adjacent conductor sections 23. Continue above two sub-steps to form a string of LED lamps 20 including a plurality of units each including a LED lamp 21, two conductor sections 23, and the resistor 22.

Step 3: Bend the conductor sections 23 of each unit and insert the straight portions of the conductor sections 23 and the LED lamp 21 of each unit into the dent 11 with two wing portions of the conductor sections 23 rested on the top groove 12.

Step 4: Dispose front most and rearmost conductor sections 230 on the main wire 30 in front and rear sides of the inner layer 10 respectively by a tool. As such, the main wires 30 and 31 interconnect a power source (not shown) and the string of LED lamps 20 to form an electric circuit.

Step 5: Wrap up the inner layer 10 and the string of LED lamps 20 by a plastic material the same as the inner layer 10 by extruding to form a jacket 40.

Figure 4:
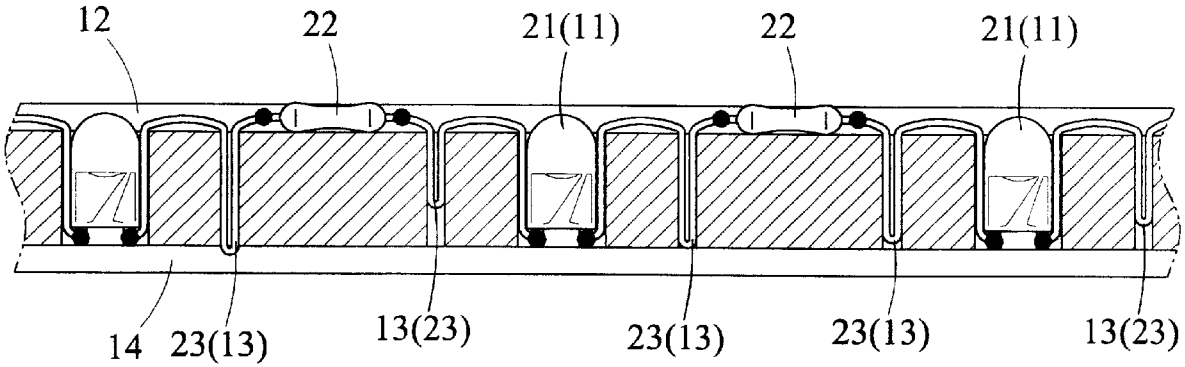
FIG. 4 is a cross-sectional view of another embodiment of the flexible rod light according to the invention.

Referring to FIG. 4, there is shown another embodiment of the flexible rod light wherein a plurality of slots 13 are formed in the inner layer 10 so that an excess length of conductor section 23 can be inserted into the slot 13. This has the benefit of permitting a pulling of the resistor 22 without disengaging the conductor section 23 from the adjacent resistor 22 and the LED lamp 21.

Figure 5:
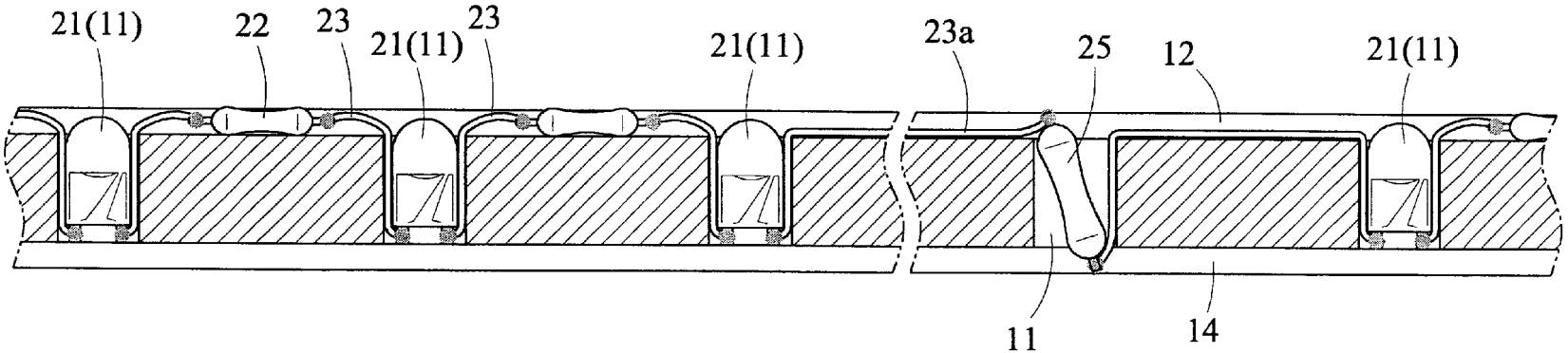
FIG. 5 is a view similar to FIG. 4, showing still another embodiment of the flexible rod light according to the invention.

Referring to FIG. 5, there is shown still another embodiment of the flexible rod light wherein one or more dents 11 are used to receive one or more second resistors having a large resistance 25. Moreover, an excess length of a coupled conductor section 23*a* can be inserted into the same dent 11 as the second resistor 25. This also has the benefit of enhancing flexibility of the conductor section 23*a*.

Figure 6A:
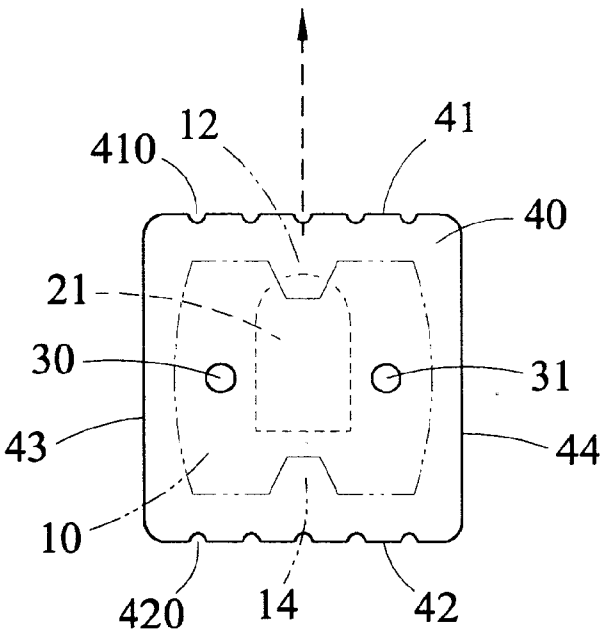
FIG. 6A is a view similar to FIG. 6, showing another embodiment of the jacket.
Figure 6:
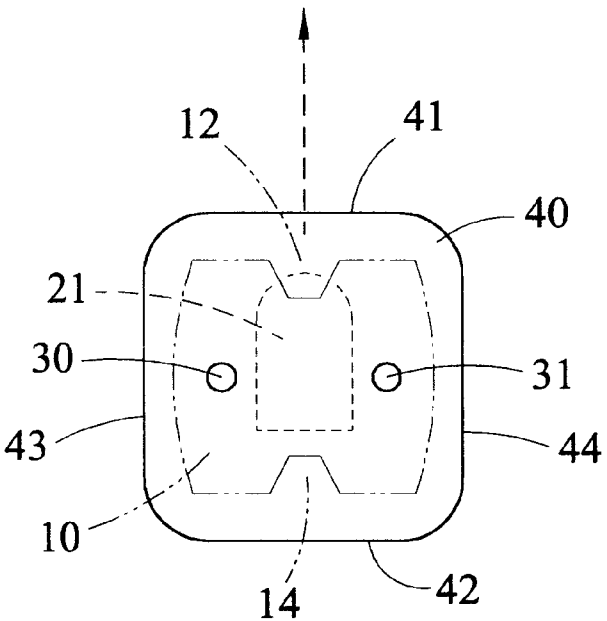
FIG. 6 is a side plan view of the light.
Figure 7:
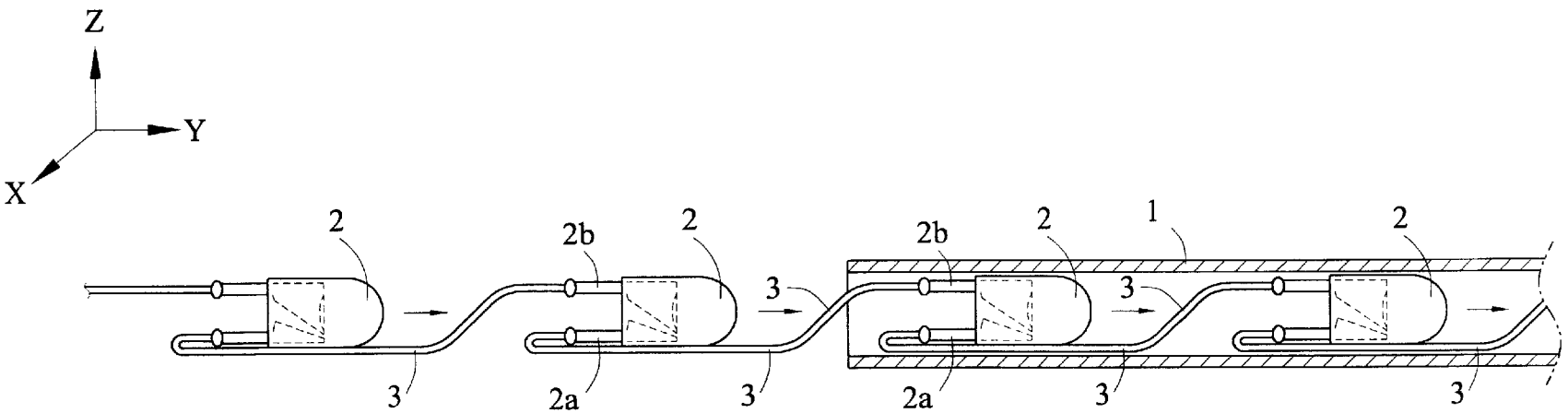
FIG. 7(PRIOR ART)
FIG. 7 is a side view in part section for illustrating a process of manufacturing a conventional flexible rod light.

Referring to FIG. 6, there is shown a side plan view of the light. A smoothness of the top and bottom surface 41 and 42 of the jacket 40 can be seen clearly. Also, light emitted from the LED lamp 21 (as indicated by arrow) concentrates in a direction perpendicular to the top surface 41, thus obtaining an increased illumination.

Referring to FIG. 6A, there is shown another embodiment of the jacket 40 wherein a plurality of parallel troughs 410 and 420 are formed on the top and bottom surfaces 41 and 42 respectively.

Also, side surfaces 43 and 44 of the jacket 40 can be made flat. Thus, a substantially rectangular or square cross-section of the light is obtained.

The benefits of this invention include: The LED lamps 21 are fastened and have the same orientation. Enhanced flexibility of the conductor sections 23 on, for example, X-Y plane. Protection resistors 22 against damage. Easy installation due to the flat top and bottom surfaces 41 and 42 of the jacket 40. Light emitted from LED lamps 21 can concentrate in a direction perpendicular to the top surface 41, i.e., increased illumination.

While the invention herein disclosed has been described by means of specific embodiments, numerous modifications and variations could be made thereto by those skilled in the art without departing from the scope and spirit of the invention set forth in the claims.

What is claimed is:

1. A method of manufacturing a flexible rod light device having concentrated light and increased flexibility to withstand a pulling thereof, the method comprising the steps of:

(a) wrapping a parallel pair of main wires in a substantially H-shaped inner layer formed of a flexible elongate plastic material proximate sides by molding;

(b) soldering an end of a resistor to an other end of a conductor section and the other end thereof to an other end of another adjacent conductor section and soldering terminals of a LED lamp to ends of the adjacent conductor sections for a unit including the LED lamp, two conductor sections, and the resistor;

(c) continuing step (b) to form a string of LED lamps including a plurality of units;

(d) bending the conductor sections of each unit and inserting straight portions of the conductor sections and the LED lamp of each unit into one of a plurality of dents on a top of the inner layer with two wing portions of the conductor sections rested on a top groove of the inner layer;

(e) disposing front most and rearmost conductor sections on the main wire in front and rear sides of the inner layer respectively; and (f) wrapping up the inner layer and the string of LED lamps by a material the same as the inner layer by extruding to form a jacket.

2. A flexible rod light device having concentrated light and increased flexibility to withstand a pulling thereof, the light device comprising:

a substantially H-shaped inner layer formed of a flexible elongate transparent or half-transparent plastic material and including lengthwise top and bottom grooves and a plurality of equally spaced apart dents on the top groove;

a string of LED lamps comprising a plurality of series connected units each including a LED lamp, two substantially 90 degrees bent conductor sections with the LED lamp received in a substantially U section of the conductor sections and electrically connected thereto by connecting terminals of the LED lamp to one ends of adjacent conductor sections, and a resistor interconnecting the other end of the conductor section and the other end of the conductor section of an adjacent unit wherein straight portions of the conductor sections and the LED lamp of each unit are rested on the dent and two wing portions of the conductor sections are rested on the top groove;

a pair of main wires parallel disposed in the inner layer proximate sides wherein front most and rearmost conductor sections are rested on the main wires in front and rear sides of the inner layer respectively; and a jacket, formed of the same material as the inner layer, wrapped up the inner layer and the string of LED lamps.

3. The device of claim 2, wherein the jacket has flat top and bottom surfaces so that light emitted from the LED lamps is concentrated in a direction perpendicular to the top surface.

4. The device of claim 2, wherein the inner layer further comprises a plurality of slots so that an excess length of the conductor section is capable of inserting into each slot.

5. The device of claim 2, wherein one or more dents are configured to receive one or more second resistors having a large resistance.

6. The device of claim 5, wherein an excess length of the coupled conductor section is capable of inserting into the same dent as the second resistor.

7. The device of claim 3, further comprising a plurality of parallel troughs formed on the top and the bottom surfaces of the jacket respectively.

8. The device of claim 2, wherein the jacket has a substantially rectangular cross-section.

9. The device of claim 2, wherein the jacket has a substantially square cross-section.

* * * * *